United States Patent [19]

Wallimann

[11] 4,394,550

[45] Jul. 19, 1983

[54] GAS-BLAST SWITCH ACTUATABLE BY A MECHANICAL DRIVE BY MEANS OF A DRIVE ELEMENT

[75] Inventor: Hubert Wallimann, Oberentfelden, Switzerland

[73] Assignee: Sprecher & Schuh AG, Aarau, Switzerland

[21] Appl. No.: 270,782

[22] Filed: Jun. 5, 1981

[30] Foreign Application Priority Data

Jul. 4, 1980 [CH] Switzerland ..... 5152/80

[51] Int. Cl.[3] ..... H01H 7/03; H01H 33/42

[52] U.S. Cl. ..... 200/34; 200/148 F

[58] Field of Search ..... 200/34, 148 R, 148 A, 200/148 F, 150 R, 150 B, 150 J

[56] References Cited

U.S. PATENT DOCUMENTS

| | | | |
|---|---|---|---|
| 2,598,446 | 5/1952 | Schneider | 200/148 F X |
| 2,804,513 | 8/1957 | Oppel | 200/34 |
| 4,230,920 | 10/1980 | Thaler | 200/150 G X |

FOREIGN PATENT DOCUMENTS

| | | |
|---|---|---|
| 1081542 | 5/1960 | Fed. Rep. of Germany . |
| 385955 | 3/1964 | Switzerland . |
| 601910 | 7/1978 | Switzerland . |

*Primary Examiner*—J. R. Scott

*Attorney, Agent, or Firm*—Werner W. Kleeman

[57] ABSTRACT

A drive element coupled with a mechanical drive is guided out of a switch housing through a through-passage housing containing a liquid bath. In the liquid bath there is immersed a hydraulic damping device containing a cylinder and piston and cooperating with said drive element, so that, with virtually no additional constructional expenditure at the drive, there is achieved a dependable braking of the drive element towards the end of a switching stroke. The piston of the hydraulic damping device is connected by means of a drag connection with the drive element. This drag connection includes at least one entrainment rod connected with the piston and acted upon by an entrainment collar provided at the drive element.

7 Claims, 1 Drawing Figure

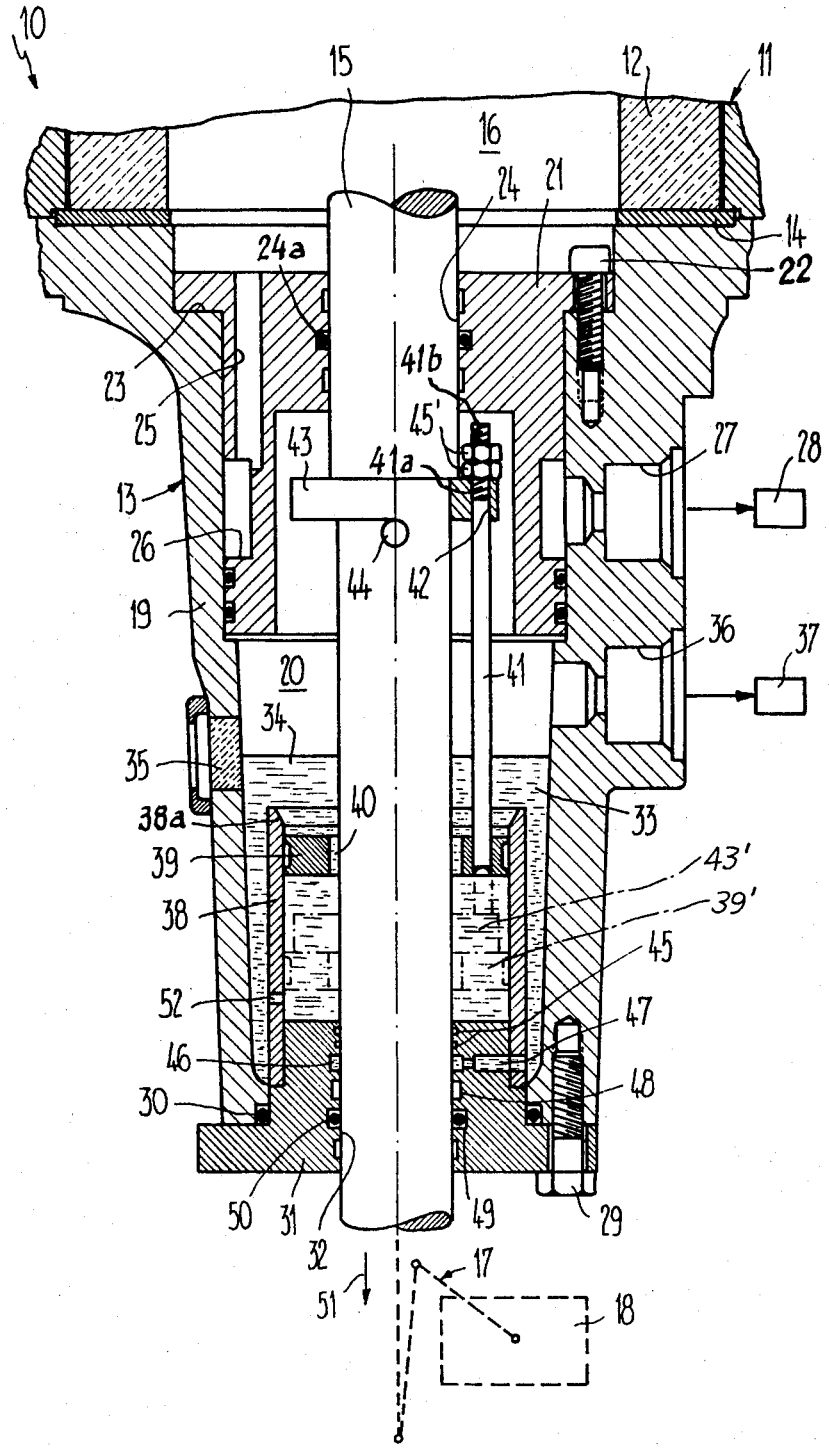
10
15
12
11
16
24
21
14
24a
22
23
41b
25
45'
43
41a
27
28
13
26
44
42
19
36
37
20
41
34
35
40
33
38a
39
43'
38
39'
45
52
47
46
48
30
50
31
32
49
29
51
17
18

GAS-BLAST SWITCH ACTUATABLE BY A MECHANICAL DRIVE BY MEANS OF A DRIVE ELEMENT

BACKGROUND OF THE INVENTION

The present invention relates to a new and improved construction of gas-blast switch actuatable by a mechanical drive by means of a drive element.

Generally speaking, the gas-blast switch of the invention comprises a switch housing and connected thereto a through-passage housing containing a liquid bath, through which the drive element is guided out of the switch housing. A gas-blast switch of this type is known, for instance, from Swiss Pat. No. 385,955 and German Pat. No. 1,081,542. The liquid bath facilitates the sealing of the internal space of the switch housing against the external space or surroundings and in which the switch drive is most commonly located. The internal space or chamber of the switch housing is filled under pressure with a electronegative gas, like for instance, $SF_6$.

Mechanical switch drives, in particular drives with a spring force storage, are preferable to comparable hydraulic switch drives, as known, for instance, from Swiss Pat. No. 601,910, since they are simpler in design, and therefore, more reliable in operation as well as working with reduced inertia.

At the beginning of a switching stroke considerable masses have to be accelerated and, at the end of the stroke, have to be again braked.

Various measures have been proposed to achieve this braking of the moving elements or parts in gas-blast switches, including switches where the drive element is not guided through a liquid bath. Commonly these measures consisted in operatively associating with the drive unit a separate hydraulic or pneumatic braking or damping device which came into operation at the end of a switching stroke, i.e. a cut-on or a cut-off stroke. Designs of this type require a certain additional constructional expenditure at the drive unit which thus becomes more complicated and less reliable in operation.

SUMMARY OF THE INVENTION

Hence, with the foregoing in mind the present invention aims at the provision of a new and improved construction of a gas-blast switch of the previous mentioned type which is characterized by an exceedingly simple construction of the drive unit and ensures for an effective braking or damping of the motion of the drive element.

Now in order to implement these objects and others which will become more readily apparent as the description proceeds, the proposed gas-blast switch of the present invention contemplates that there is immersed in the liquid bath a hydraulic damping device which cooperates with the drive element.

The liquid in the liquid bath, with this switch design, therefore not only serves as a sealing agent between the excess pressurized electronegative extinguishing or quenching gas in the switch housing and the surrounding or ambient space thereof, but such liquid also serves as the hydraulic liquid necessary for the operation of the hydraulic damping device.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE shows a longitudinal axial sectional view through that section or portion of the proposed gas-blast switch which is of interest in the context of the present description.

DETAILED DESCRIPTION OF THE PREFERRED EMBODIMENTS

Describing now the drawing, the illustrated exemplary embodiment of gas-blast switch 10 will be seen to possess a substantially vertically arranged housing 11 of which only the lower portion, i.e. a part of the support insulator 12, has been shown. The substantially tubular-shaped housing 11 is filled with a pressurized electronegative gas such as, for instance, $SF_6$ and at its lower end is sealingly closed by a through-passage housing 13 while interposing a seal 14. The through-passage housing 13 essentially serves for sealingly guiding a thrust rod 15 out of the internal chamber or space 16 of the housing 11 and which is pressurized by the gas. Coupled with the upper end of the thrust rod 15 are the here not further illustrated movable elements of the gas-blast switch.

As schematically indicated, the lower end of the thrust rod 15 which constitutes a drive element, i.e. the end protruding out of the through-passage housing 13, is coupled with a mechanical drive unit 18 by means of a lever transmission or drive 17. This mechanical drive unit or drive means 18 can be, for instance, a spring force storage, by means of which the thrust rod can be longitudinally displaced back-and-forth. The through-passage or through-pass housing 13 is formed by a substantially tubular-shaped housing body 19, the internal space or chamber 20 of which is sealingly separated from the internal space or chamber 16 by means of a guide sleeve or bushing 21. The guide sleeve or bushing 21 is secured to a shoulder 23 in the housing body 19 by means of bolts 22 or equivalent fastening expedients and contains a central guide bore 24 for the thrust rod 15. The central bore 24 is provided with a sealing ring **24*a*. Furthermore, the guide sleeve or bushing 21 is provided with another longitudinal bore 25 ending in a peripheral slot or channel 26. This peripheral slot 26, in turn, communicates with a connection bore 27 provided in the housing body 19. Such bore 27** is provided with a non-return or check valve which may close toward the outside and has not been particularly shown in the drawing.

As schematically indicated, the connection bore 27 will normally be connected to a gas monitor 28, by means of which the gas condition in the internal space or chamber 16 can be checked. The lower end of the housing body 19 is closed by a floor or base element 31 which is secured thereto by means of threaded bolts 29 or the like and is sealed by a seal or sealing element 30. This base or floor element 31 is also provided with a guide bore 32 for the thrust rod 15. The internal chamber or space 20 contains a liquid bath 33, the level of which can be checked from the outside through a sight or gauge glass 35 incorporated in the housing body 19. The portion of the internal chamber or space 20 which is located above the liquid level 34 also is filled with a gas which likewise can be an electronegative gas and equally can be pressurized. The pressure thereof can be equal to or less than the pressure of the gas in the internal chamber or space 16. Leading from that portion of the internal chamber or space 20 which is above the liquid level 34 is a connection bore 36 which, in turn, can incorporate another, not particularly illustrated but conventional non-return or check valve which closes towards the outside. Such connection bore 36 is normally coupled with a further gas monitor 37.

The liquid bath 33 can consist of an oil or another hydraulic liquid. Entirely immersed therein and secured to the floor or base element 31 is a cylinder 38 with an open upper end 38*a*. A substantially ring-shaped piston 39 is mounted to be displaceable in the cylinder 38 and surrounds the thrust rod 15 with clearance, so that a ring-shaped or annular gap 40 is formed between the thrust rod 15 and the piston 39. Coupled with the piston 39 and extending upwards through the liquid bath 33 are several entrainment rods 41, of which only one is indicated in the drawing. The upper rod end 41*a* thereof extends displaceably through a peripheral bore 42 in an entrainment ring or circumferential collar 43 which is fitted on the thrust rod 15 and is secured in place by means of a locking pin 44. The upper end 41*a* of each entrainment rod 41 is provided with an external thread 41*b* and to which threaded rod end there are screwed two nuts 45' which serve as an entrainment stop during the cut-on stroke, as will be described more fully hereinafter.

The piston 39 is thus connected to the drive element or thrust rod 15 by means of a drag connection consisting of the elements 41, 42, 43, 44 and 45'. It should also be mentioned that the guide bore 32 incorporates a number of annular grooves which are open towards the inside. Situated closest to the liquid bath 33 are two annular grooves 45 which produce a substantially labyrinth-like or turbulence seal. Next to the annular grooves 45 there is arranged a pressure relief groove 46 from which a through-passage or bore 47 or the like leads directly back to the liquid bath 33. There then follows another annular groove 48 which can serve, for instance, to receive an oil scraper ring. Following the annular groove 48 is another groove 49 in which there is inserted a liquid sealing ring 50 which tightly surrounds the thrust rod 15.

The cylinder 38 and the piston 39 which is coupled with the thrust rod 15 by means of the drag connection 41, 42, 43, 44, 45' are thus both immersed in the liquid bath 33. At the end of a switching stroke they thereby function as a brake which is independent from the drive unit 18.

Now, if referring to the cut-on position shown in the drawing, there occurs a cut-off stroke, then the thrust rod 15 is moved downward by the drive unit 18, i.e. in the direction of the arrow 51. Initially, this motion does not meet any resistance, since the entrainment ring 43 is displaced upon the entrainment rod 41. Apart from its own weight, the piston 31 has no reason to penetrate any further into the cylinder 38. However, towards the end of the cut-off stroke the entrainment ring 43 impinges upon the piston 39 and entrains the same, while closing the substantially ring-shaped or annular gap 40. As a result, liquid is expelled out of the cylinder 38, but only through a throttle bore 52 located at the region of the base or floor element 31. There thus occurs an effective braking or deceleration until the cut-off stroke has ended, i.e. until the piston 39 and the entrainment ring 43 have reached the position indicated in the drawing by dotted lines and indicated by reference numerals 39' and 43', respectively. During a cut-on stroke and starting from the position indicated by dotted or phantom lines in the drawing, the thrust rod 15 initially moves freely upwards. The entrainment ring 43 is lifted from the piston 39 and frees the substantially ring-shaped or annular gap 40. This free motion of the thrust rod 15 continues until, towards the end of the cut-on stroke, the entrainment ring 43 impacts against the nuts 45'. Thereafter, the thrust rod 15 entrains the piston 39 whereby the former is braked or decelerated. However, the braking effect at the end of the cut-on stroke is not as strong as at the end of a cut-off stroke, since now the substantially ring-shaped or annular gap 40 is open, i.e. the pulling up of the piston 39 permits liquid to flow back into the cylinder 38 not only through the throttle bore 52 but also through the substantially ring-shaped or annular gap 40. This is justified especially for switches where the movable contact elements frictionally engage at the fixed contact elements, because with such switches the interaction of the contact elements produces a further braking or deceleration effect.

Thus, in the proposed switch the liquid bath 33 has two functions. Firstly, it assures a good, gas-tight sealing of the through-passage location of the thrust rod 15 and, secondly, it serves as a sump for the hydraulic damping or braking device.

Furthermore, the separation of the internal chambers or spaces 16 and 20 by means of the guide sleeve or bushing 21 allows bridging in stages the pressure gradient or drop between the inner space and the surroundings, so that the liquid bath 33 is at a lower pressure than the internal space 16. Thus, the sealing capacity of the already pressure relieved sealing ring 50 is further improved. In addition, this separation of the internal chambers or spaces 16 and 20 allows the use of different gases, i.e. for instance purely an extinguishing gas for the internal space 16 as opposed to the internal space 20 where there can be used a different gas which is particularly compatible with the liquid in the liquid bath 33.

While there are shown and described preferred embodiments of the invention, it is to be distinctly understood that the invention is not limited thereto, but may be embodied and practised within the scope of the following claims. Accordingly,

What is claimed is:

1. A gas-blast switch containing an operating mechanism including a damping device comprising a mechanical drive;

a drive element connected to said mechanical drive;

said gas-blast switch being actuatable by means of said mechanical drive and said drive element;

a switch housing;

a through-passage housing connected to said switch housing and containing a liquid bath;

said drive element being guided out of said switch housing through said through-passage housing and said liquid bath, with said liquid bath serving as a gas-tight seal for said drive element; and a hydraulic damping device immersed in said liquid bath within said through-passage housing and cooperating with the drive element.

2. The gas-blast switch as defined in claim 1, wherein:

said drive element comprises a thrust rod longitudinally displaceable back-and-forth; and said damping device comprises a cylinder-piston unit which is arranged substantially parallel with respect to said thrust rod.

3. The gas-blast switch as defined in claim 2, wherein:

said cylinder-piston unit is substantially coaxially arranged with respect to said thrust rod.

4. The gas-blast switch as defined in claim 3, wherein:

said cylinder of the cylinder-piston unit is secured to the through-passage housing; and a drag connection means for coupling said piston of the cylinder-piston unit with the thrust rod.

5. The gas-blast switch as defined in claim 4, wherein:

said drag connection means comprises at least one entrainment rod coupled with said piston;

an entrainment collar provided for said thrust rod; and said entrainment rod engaging through said entrainment collar on the thrust rod and being displaceable therethrough to a limited extent.

6. The gas-blast switch as defined in claim 5, wherein:

said piston surrounds the thrust rod while leaving free an annular gap; and said entrainment collar during the course of a cut-off stroke of the gas-blast switch serving as a closure element for said annular gap.

7. The gas-blast switch as defined in claim 6, wherein:

said entrainment collar comprises an entrainment ring.

* * * * *